US010851778B2

(12) United States Patent
Furuhashi et al.

(10) Patent No.: US 10,851,778 B2
(45) Date of Patent: Dec. 1, 2020

(54) FUEL PUMP HAVING PUMP CHAMBERS FORMED BETWEEN OUTER GEAR AND INNER GEAR

(71) Applicant: DENSO CORPORATION, Kariya (JP)

(72) Inventors: Daiji Furuhashi, Kariya (JP); Hiromi Sakai, Kariya (JP); Tetsuo Hayakawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 322 days.

(21) Appl. No.: 15/780,059

(22) PCT Filed: Dec. 1, 2016

(86) PCT No.: PCT/JP2016/085655
§ 371 (c)(1),
(2) Date: May 30, 2018

(87) PCT Pub. No.: WO2017/104420
PCT Pub. Date: Jun. 22, 2017

(65) Prior Publication Data

US 2018/0372096 A1 Dec. 27, 2018

(30) Foreign Application Priority Data

Dec. 15, 2015 (JP) ..... 2015-244538

(51) Int. Cl.
*F02M 37/08* (2006.01)
*F04C 11/00* (2006.01)
(Continued)

(52) U.S. Cl.
CPC ..... *F04C 15/00* (2013.01); *F02M 37/08* (2013.01); *F04C 2/102* (2013.01); *F04C 13/008* (2013.01); *F04C 15/06* (2013.01); *F04C 2210/203* (2013.01); *F04C 2240/30* (2013.01); *F04C 2240/40* (2013.01); *F04C 2240/50* (2013.01); *F04C 2240/54* (2013.01); *F04C 2240/60* (2013.01)

(58) Field of Classification Search
CPC ..... F04C 15/00; F04C 2/102; F04C 15/06; F04C 15/0061; F04C 11/008; F02M 37/08
USPC ..... 417/360
See application file for complete search history.

(56) References Cited

U.S. PATENT DOCUMENTS 5,393,203 A * 2/1995 Hantle ..... F02M 37/08 417/203
6,082,984 A 7/2000 Matsumoto et al.
(Continued)

FOREIGN PATENT DOCUMENTS

JP 11-324839 11/1999

*Primary Examiner* — Deming Wan
(74) *Attorney, Agent, or Firm* — Nixon & Vanderhye P.C.

(57) ABSTRACT

A casing of a housing of a fuel pump has a bearing surface that rotatably supports an inner gear in an axial direction from a motor side while a plain bearing extends through the bearing surface. The plain bearing includes: an inner-peripheral-side step that is stepped by increasing an inner diameter of the plain bearing on a counter-motor side of the inner-peripheral-side step in the axial direction; and an outer-peripheral-side step that is stepped by increasing an outer diameter of the plain bearing on the motor side of the outer-peripheral-side step at a position that is on the motor side of the bearing surface in the axial direction.

5 Claims, 4 Drawing Sheets

(51) Int. Cl.

| | |
|---|---|
| ***F04C 15/00*** | (2006.01) |
| ***F04C 2/10*** | (2006.01) |
| ***F04C 13/00*** | (2006.01) |
| ***F04C 15/06*** | (2006.01) |

(56) References Cited

U.S. PATENT DOCUMENTS

| | | | | |
|---|---|---|---|---|
| 6,106,240 | A | 8/2000 | Fischer et al. | |
| 2001/0026767 | A1 | 10/2001 | Takagi et al. | |
| 2002/0122736 | A1 | 9/2002 | Takagi | |
| 2003/0026722 | A1 | 2/2003 | Takagi et al. | |
| 2008/0199334 | A1* | 8/2008 | Sorensen | H02K 1/2726 417/423.7 |
| 2012/0027629 | A1* | 2/2012 | Tanahashi | F04D 5/002 417/410.1 |

* cited by examiner

FUEL PUMP HAVING PUMP CHAMBERS FORMED BETWEEN OUTER GEAR AND INNER GEAR

CROSS REFERENCE TO RELATED APPLICATION

This application is the U.S. national phase of International Application No. PCT/JP2016/085655 filed Dec. 1, 2016, which designated the U.S. and claims priority to Japanese Patent Application No. 2015-244538 filed on Dec. 15, 2015, the entire contents of each of which are hereby incorporated by reference.

TECHNICAL FIELD

The present disclosure relates to a fuel pump that suctions fuel into a gear receiving chamber and then discharges the suctioned fuel from the gear receiving chamber.

BACKGROUND ART

Previously, there is known a fuel pump that suctions fuel into a gear receiving chamber and then discharges the suctioned fuel from the gear receiving chamber. A fuel pump, which is disclosed in the patent literature 1, includes: an outer gear that includes a plurality of internal teeth; an inner gear that includes a plurality of external teeth and is meshed with the outer gear while the inner gear is eccentric to the outer gear; a pump housing that defines a gear receiving chamber, which rotatably receives the outer gear and the inner gear; a rotatable shaft that is coupled to a drive source and is rotated by the drive source; and a plain bearing that is shaped into a cylindrical tubular form, while the plain bearing rotatably supports the rotatable shaft in a radial direction from a radially outer side of the rotatable shaft and rotatably supports the inner gear in the radial direction from a radially inner side of the inner gear. In this fuel pump, when the outer gear and the inner gear are rotated in response to rotation of the rotatable shaft to increase and decrease volumes of a plurality of pump chambers, which are formed between the outer gear and the inner gear, fuel is suctioned into and is then discharged from the gear receiving chamber.

It is assumed that the plain bearing of the patent literature 1 includes an inner-peripheral-side step that is stepped by increasing an inner diameter of the plain bearing on an opposite side of the inner-peripheral-side step, which is opposite from the drive source in the axial direction. By increasing the inner diameter of the plain bearing on the opposite side of the inner-peripheral-side step, which is opposite from the drive source, the outer gear and the inner gear can be smoothly rotated even in a state where the rotatable shaft is slightly tilted. In this way, a pump efficiency can be increased.

In the gear receiving chamber, some pump chambers have a relatively high fuel pressure while some other pump chambers have a relatively low fuel pressure since the volumes of the pump chambers are increased and decreased. Therefore, the inner gear is urged from the high pressure pump chamber side toward the low pressure pump chamber side, and thereby the plain bearing receives a radial load. In such a case, since the wall thickness of the plain bearing is reduced by increasing the inner diameter of the plain bearing, there is a possibility of damaging the plain bearing.

CITATION LIST

Patent Literature

PATENT LITERATURE 1: JPH11-324839A (corresponding to U.S. Pat. No. 6,082,984A)

SUMMARY OF INVENTION

The present disclosure is made in view of the above disadvantage, and it is an objective of the present disclosure to provide s fuel pump that has a high pump efficiency and can limit a damage of a plain bearing.

In order to achieve the above objective, according to the present disclosure, there is provided a fuel pump including:

an outer gear that includes a plurality of internal teeth;

an inner gear that includes a plurality of external teeth and is meshed with the outer gear while the inner gear is eccentric to the outer gear;

a pump housing that defines a gear receiving chamber, which rotatably receives the outer gear and the inner gear;

a rotatable shaft that is coupled to a drive source and is rotated by the drive source; and a plain bearing that is shaped into a cylindrical tubular form, while the plain bearing rotatably supports the rotatable shaft in a radial direction from a radially outer side of the rotatable shaft and rotatably supports the inner gear in the radial direction from a radially inner side of the inner gear, and when the outer gear and the inner gear are rotated in response to rotation of the rotatable shaft to increase and decrease volumes of a plurality of pump chambers, which are formed between the outer gear and the inner gear, fuel is suctioned into and is then discharged from the gear receiving chamber, wherein:

the pump housing includes a bearing surface that rotatably supports the inner gear in an axial direction from the drive source side, while the plain bearing extends through the bearing surface; and the plain bearing includes:

an inner-peripheral-side step that is stepped by increasing an inner diameter of the plain bearing on an opposite side of the inner-peripheral-side step, which is opposite from the drive source in the axial direction; and an outer-peripheral-side step that is stepped by increasing an outer diameter of the plain bearing on the drive source side of the outer-peripheral-side step at a position that is on the drive source side of the bearing surface in the axial direction.

With the above construction, the plain bearing includes the outer-peripheral-side step that is stepped by increasing the outer diameter on the drive source side of the outer-peripheral-side step. When the outer-peripheral-side step is applied to the plain bearing, which has the inner-peripheral-side step, the wall thickness of the plain bearing is increased due to the increase in the outer diameter. Thereby, the plain bearing is reinforced. The outer-peripheral-side step is formed on the drive source side of the bearing surface in the axial direction. Therefore, even when the inner gear is rotatably supported in the radial direction from the radially inner side of the inner gear, the inner gear can be smoothly rotated since the outer-peripheral-side step does not interfere with the inner gear. Thereby, the fuel pump, which has the high pump efficiency, can be provided while limiting the damage to the plain bearing.

DESCRIPTION OF EMBODIMENTS

Hereinafter, various embodiments of the present disclosure will be described with reference to the accompanying drawings. In the following respective embodiments, corresponding structural elements are indicated by the same reference signs and may not be redundantly described. In a case where only a part of the structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly described as long as there is no problem.

First Embodiment

Figure 1:
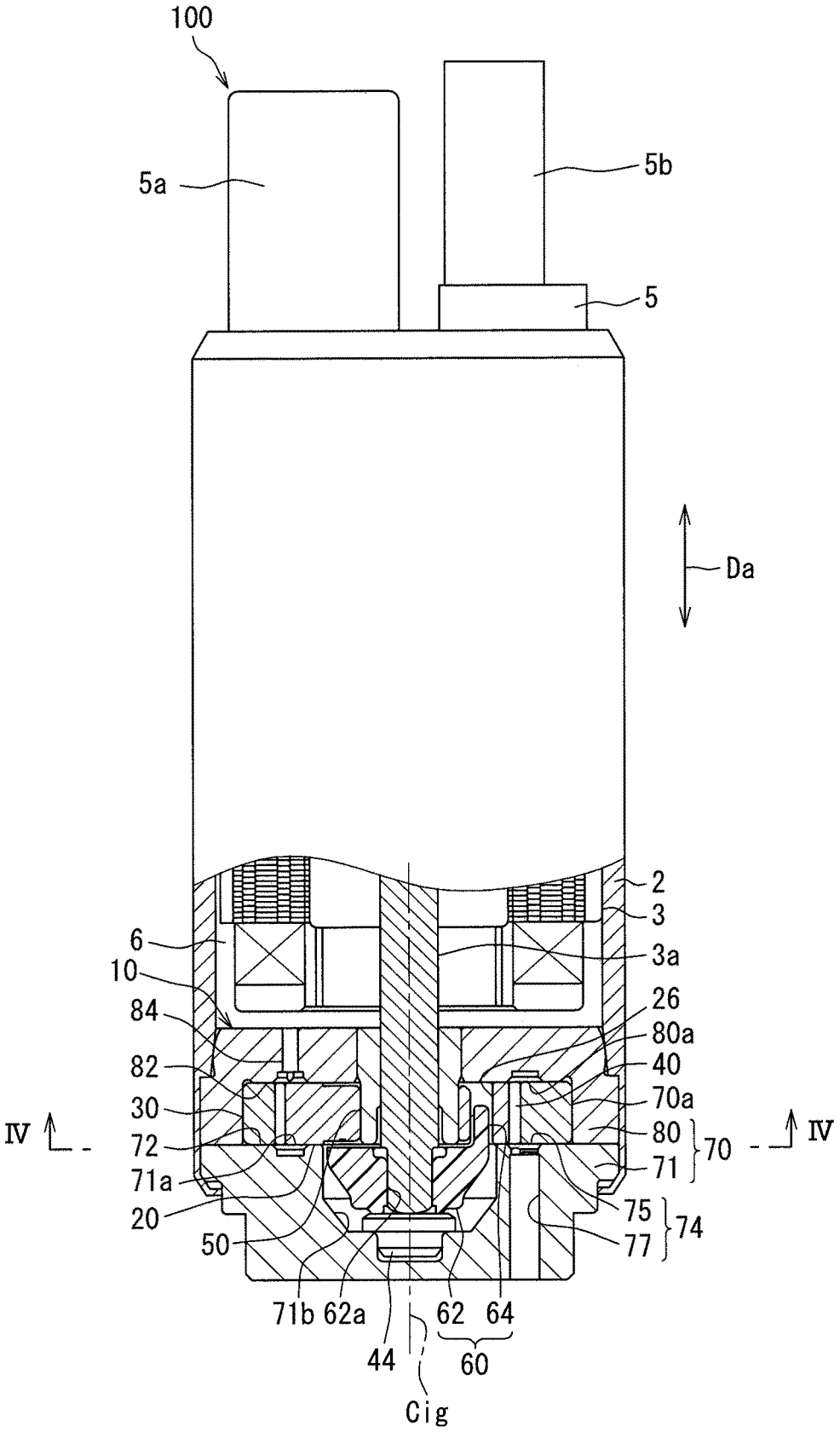
FIG. 1 is a partially fragmented front view of a fuel pump according to a first embodiment.
Figure 2:
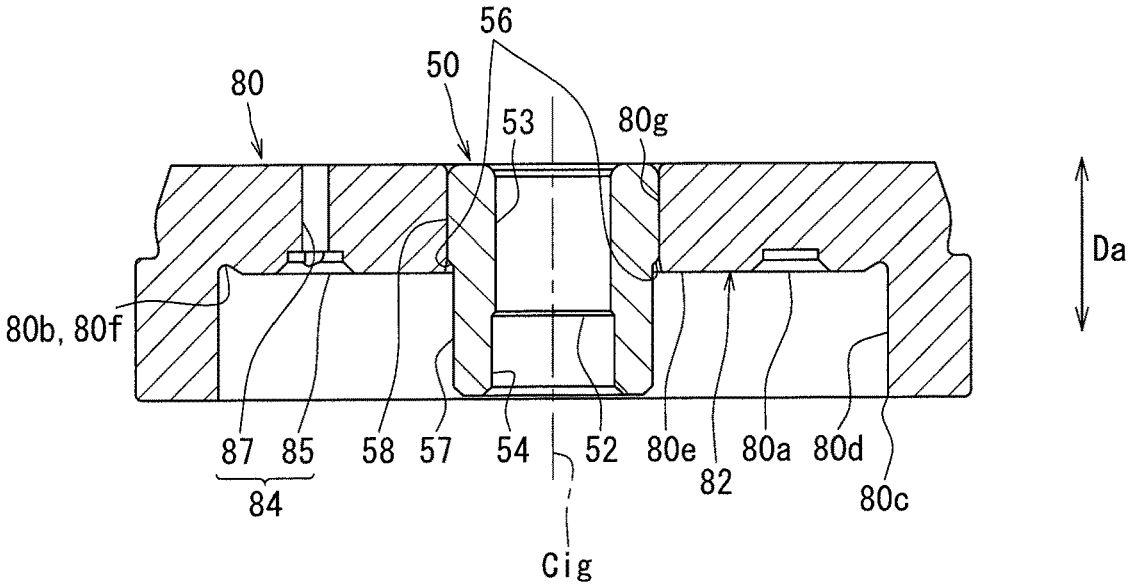
FIG. 2 is a cross-sectional view of a pump casing according to the first embodiment.
Figure 3:
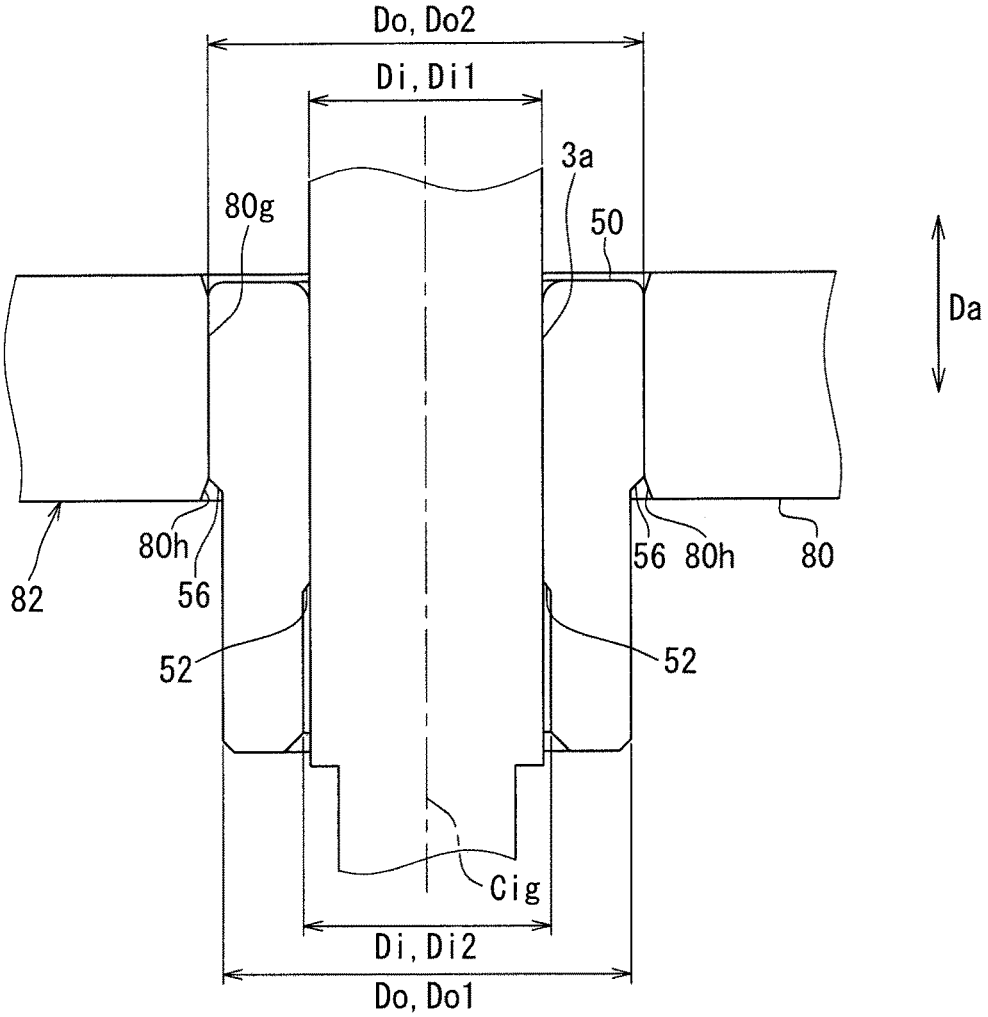
FIG. 3 is a partially enlarged view showing a plan bearing and its adjacent area shown in FIG. 1.

As shown in FIG. 1, a fuel pump 100 according to a first embodiment of the present disclosure is a positive displacement trochoid pump. The fuel pump 100 is a diesel pump that is installed to a vehicle and is used to pump light oil, which is fuel combusted in an internal combustion engine and has a viscosity higher than that of gasoline. The fuel pump 100 includes: an electric motor 3, which is received in an inside of a pump body 2 shaped into an annular form; a pump main body 10; and a side cover 5 while the side cover 5 outwardly projects on an opposite side of the electric motor 3, which is opposite from the pump main body 10 in an axial direction Da.

In this fuel pump 100, a rotatable shaft 3*a*, which is connected to the electric motor 3, is rotated when an electric power is supplied from an external circuit to the electric motor 3 through an electric connector 5*a* of the side cover 5. An outer gear 30 and an inner gear 20 of the pump main body 10 are rotated by a drive force of the rotatable shaft 3*a*. Thereby, the fuel, which is suctioned into and pressurized in a gear receiving chamber 70*a* shaped into a cylindrical form to receive the inner and outer gears 20, 30, is discharged from a discharge outlet 5*b* of the side cover 5 through a fuel passage 6 located at an outside of the gear receiving chamber 70*a*.

In the present embodiment, the electric motor 3, which serves as a drive source, is an inner rotor brushless motor that includes magnets, which form four magnetic poles, and coils, which are installed in six slots. For example, when an ignition key of the vehicle is turned on, or when an accelerator pedal of the vehicle is depressed, a positioning control operation, which rotates the electric motor 3 to rotate the rotatable shaft 3*a* in a driving-rotational direction or a counter-driving-rotational direction, is executed. Thereafter, a drive control operation is executed at the electric motor 3 to rotate the rotatable shaft 3*a* in the driving-rotational direction from the position that is set through the positioning control operation.

Here, the driving-rotational direction refers to a positive direction of a rotational direction Rig (see FIG. 4) about an inner central axis Cig of the inner gear 20. Furthermore, the counter-driving-rotational direction refers to a negative direction of the rotational direction Rig (see FIG. 4).

Additionally referring to FIGS. 2 to 5, a structure and an operation of the fuel pump 100 will now be described in detail mainly with respect to the pump main body 10. The pump main body 10 includes a pump housing 70, a plain bearing 50, an inner gear 20, a joint member 60 and the outer gear 30. In the pump housing 70, a pump cover 71 and a pump casing 80 are overlapped with each other in the axial direction Da to form the gear receiving chamber 70*a*, which is shaped into the cylindrical form and rotatably receives the inner and outer gears 20, 30, between the pump cover 71 and the pump casing 80.

The pump cover 71 shown in FIG. 1 is a constituent component of the pump housing 70. The pump cover 71 is formed into a circular disk having abrasion resistance by applying a surface treatment, such as plating, to a rigid metal base material, such as a steel material. The pump cover 71 outwardly projects from an opposite end of the pump body 2, which is opposite from the electric motor 3 in the axial direction.

The pump cover 71 has a cover bearing surface 72, which is a planar surface and is opposed to the gear receiving chamber 70*a* to rotatably support the inner gear 20 and the outer gear 30 in the axial direction Da from an opposite side (hereinafter referred to as a counter-motor side), which is opposite from the electric motor 3. The pump cover 71 has a joint receiving chamber 71*b*, which receives a main body 62 of the joint member 60, at a location that is opposed to the inner gear 20 along the inner central axis Cig, which is a center of the inner gear 20. The joint receiving chamber 71*b* is recessed from the cover bearing surface 72 in the axial direction Da. A thrust bearing 44, which rotatably supports the rotatable shaft 3*a* in the axial direction Da, is securely fitted to a bottom portion of the joint receiving chamber 71*b* along the inner central axis Cig.

The pump cover 71 has a suction port 74, which is located on a radially outer side of the joint receiving chamber 71*b* and suctions the fuel from an outside of the gear receiving chamber 70*a* into an inside of the gear receiving chamber 70*a*. The suction port 74 includes a suction extension groove 75 and a plurality of suction opening holes 77. The suction extension groove 75 is an arcuate groove that is recessed from the cover bearing surface 72 and extends in a circumferential direction of the pump cover 71. The suction opening holes 77 are arranged one after another in an extending direction of the suction extension groove 75. Each of the suction opening holes 77 is formed in a form of a cylindrical hole that extends through the pump cover 71 in the axial direction Da, so that the suction opening hole 77 opens to the outside of the fuel pump 100 and a bottom portion of the suction extension groove 75.

The pump casing 80 shown in FIGS. 1 to 4 is a constituent component of the pump housing 70. The pump casing 80 is formed into a bottomed cylindrical tube having abrasion resistance by applying a surface treatment, such as plating, to a rigid metal base material, such as a steel material. An opening portion 80*c* of the pump casing 80 is covered with the pump cover 71, so that the opening portion 80*c* is closed along its entire circumferential extent. An inner peripheral portion 80*d* of the pump casing 80 is formed in a form of a cylindrical hole that is eccentric from the inner central axis Cig and is coaxial with an outer central axis Cog that is a center of the outer gear 30.

The pump casing 80 has a casing bearing surface 82, which is a planar surface formed at a recessed bottom portion 80*e* of the pump casing 80 and is opposed to the gear receiving chamber 70*a* to rotatably support the inner gear 20 and the outer gear 30 in the axial direction Da from the electric motor 3 side (hereinafter referred to as a motor side).

Figure 4:
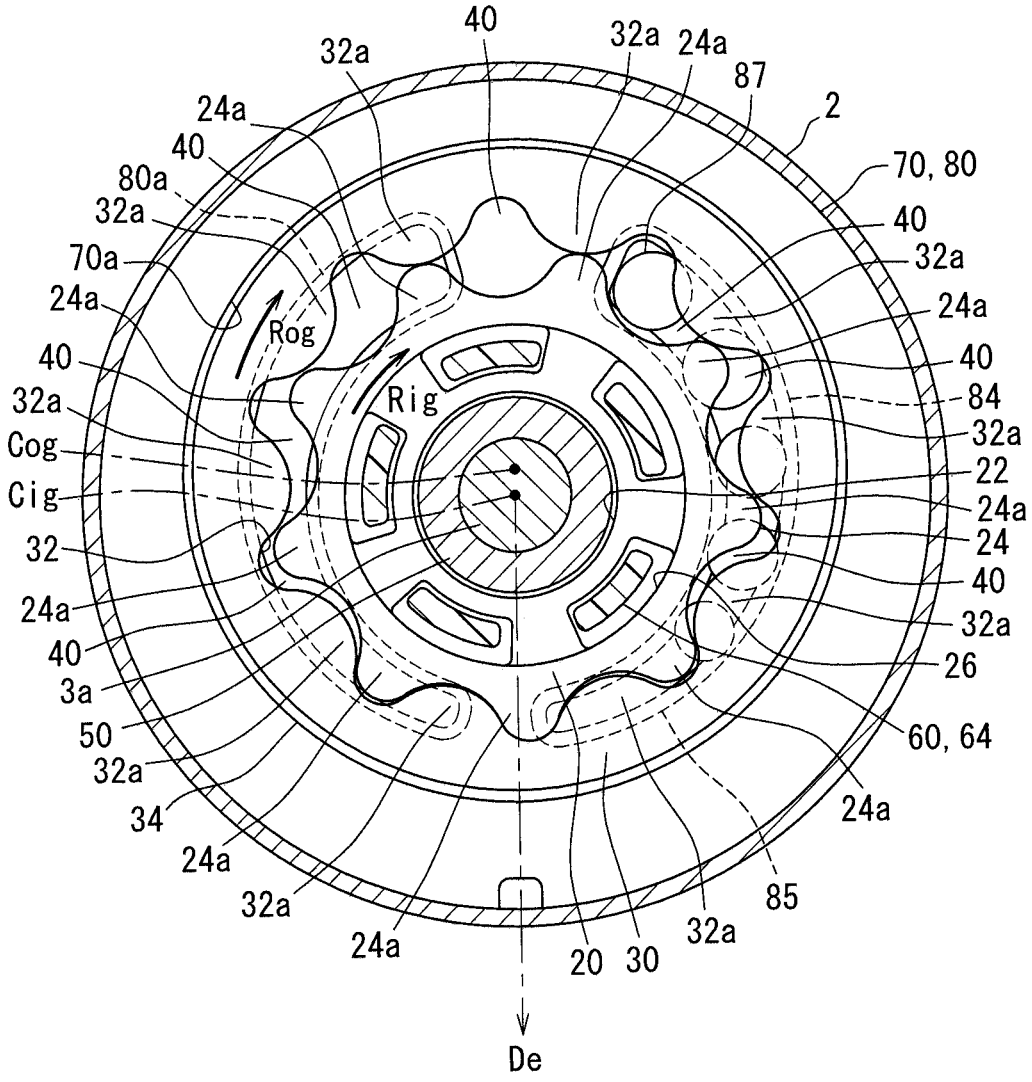
FIG. 4 is a cross-sectional view taken along line IV-IV in FIG. 1.

The pump casing 80 also has a discharge port 84 that discharges the fuel from an inside of the gear receiving chamber 70*a* to an outside of the gear receiving chamber 70*a*. The discharge port 84 includes a discharge extension groove 85 and a plurality of discharge opening holes 87. The discharge extension groove 85 is an arcuate groove that is recessed from the casing bearing surface 82 and extends in a circumferential direction of the pump casing 80. The discharge opening holes 87 are arranged one after another in an extending direction of the discharge extension groove 85. Each of the discharge opening holes 87 is formed in a form of a cylindrical hole that extends through the pump casing 80 in the axial direction Da, so that the discharge opening hole 87 opens to the fuel passage 6 and a bottom portion of the discharge extension groove 85. In FIG. 4, only one of the discharge opening holes 87 is indicated with the reference sign.

As shown in particularly FIG. 1, in the recessed bottom portion 80*e* of the pump casing 80, an opposing suction groove 80*a* is formed at a corresponding location, which is opposed to the suction extension groove 75 of the suction port 74 while the gear receiving chamber 70*a* is interposed between the opposing suction groove 80*a* and the suction extension groove 75. The opposing suction groove 80*a* is in a form of an arcuate groove that is configured to a shape formed by projecting the suction extension groove 75 in the axial direction Da. The opposing suction groove 80*a* is recessed from the casing slide surface 82. In this way, at the pump casing 80, a configuration of the discharge extension groove 85 of the discharge port 84 and a configuration of the opposing suction groove 80*a* are substantially symmetric to each other about a corresponding symmetry line. The discharge extension groove 85 and the opposing suction groove 80*a* are separated from each other by the casing slide surface 82.

In the pump cover 71, an opposing discharge groove 71*a* is formed at a location, which is opposed to the discharge extension groove 85 of the discharge port 84 while the gear receiving chamber 70*a* is interposed between the opposing discharge groove 71*a* and the discharge extension groove 85. The opposing discharge groove 71*a* is in a form of an arcuate groove that is configured to a shape formed by projecting the discharge extension groove 85 in the axial direction Da. The opposing discharge groove 71*a* is recessed from the cover bearing surface 72. In this way, at the pump cover 71, a configuration of the suction extension groove 75 of the suction port 74 and a configuration of the opposing discharge groove 71*a* are substantially symmetric to each other about a corresponding symmetry line. The suction extension groove 75 and the opposing discharge groove 71*a* are separated from each other by the cover bearing surface 72.

Furthermore, an annular groove 80*b*, which is recessed from the casing bearing surface 82 in the axial direction Da, is formed at an inner diameter corner part 80*f* located on a radially outer side of the discharge port 84 and the opposing suction groove 80*a* at the recessed bottom portion 80*e* of the pump casing 80. The annular groove 80*b* is in an annular form and communicates between a radially outer side of the discharge extension groove 85 and a radially outer side of the opposing suction groove 80*a* along an entire circumferential extent thereof in the inner diameter corner part 80*f*.

The pump casing 80 has a through-hole 80*g* that is formed along the inner central axis Cig such that the through-hole 80*g* is in a form of a cylindrical hole and extends through the pump casing 80 in the axial direction Da. The plain bearing 50 is held and fitted to the through-hole 80*g*.

The plain bearing 50 is a cylindrical bearing and is made of a sintered body. In the present embodiment, a copper-based sintered body, which includes copper powder as its material, is used as the sintered body. Alternatively, a carbon-based sintered body, which includes carbon powder or carbon compound powder as its material, may be used as the sintered body. In this type of sintered body, minute gaps are generated among the solid powder particles.

The plain bearing 50 shown in FIGS. 1 to 4 is centered about the inner central axis Cig and extends in the axial direction Da, and the rotatable shaft 3*a* is inserted through a cylindrical hole 50*a* of the plain bearing 50. A portion of the plain bearing 50, which is located on the motor side in the axial direction Da, is fitted into the through-hole 80*g* of the pump casing 80. In contrast, another portion of the plain bearing 50, which is located on the counter-motor side, projects from the casing bearing surface 82 to a location that is adjacent to the opening portion 80*c*, so that the plain bearing 50 is placed to project through the casing bearing surface 82. The plain bearing 50 has an inner-peripheral-side step 52 and an outer-peripheral-side step 56.

The inner-peripheral-side step 52 is formed at an inner peripheral wall of the cylindrical hole 50*a*. The inner-peripheral-side step 52 is stepped by increasing an inner diameter Di2 of the plain bearing 50 on the counter-motor side of the inner-peripheral-side step 52 relative to an inner diameter Di1 of the plain bearing 50 on the motor side of the inner-peripheral-side step 52. The inner-peripheral-side step 52 is positioned on the counter-motor side of the casing bearing surface 82 in the axial direction Da. In the present embodiment, a longitudinal cross section of the inner-peripheral-side step 52 is linearly formed such that the inner diameter Di of the inner-peripheral-side step 52 progressively increases toward the counter-motor side, so that the inner-peripheral-side step 52 is shaped into a form of a partial conical surface as a whole.

Due to the presence of the inner-peripheral-side step 52, the inner peripheral wall has a small inner diameter portion 53, which is located on the motor side, and a large inner diameter portion 54, which is located on the counter-motor side. In a state where the rotatable shaft 3*a* is perpendicular to the casing bearing surface 82, the small inner diameter portion 53 of the plain bearing 50 radially supports the rotatable shaft 3*a* from the radially outer side.

The outer-peripheral-side step 56 is formed at an outer peripheral wall of the plain bearing 50. The outer-peripheral-side step 56 is stepped by increasing an outer diameter Do2 of the plain bearing 50 on the motor side of the outer-peripheral-side step 56 relative to an outer diameter Do1 of the plain bearing 50 on the counter-motor side of the outer-peripheral-side step 56. The outer-peripheral-side step 56 is formed at a location that is different from a location of the inner-peripheral-side step 52 in the axial direction Da. Specifically, the outer-peripheral-side step 56 is formed at a position that is on the motor side of the casing bearing surface 82 in the axial direction Da. In the present embodiment, a longitudinal cross section of the outer-peripheral-side step 56 is linearly formed such that the outer diameter Do of the outer-peripheral-side step 56 progressively increases toward the motor side, so that the outer-peripheral-side step 56 is shaped into a form of a partial conical surface as a whole.

Due to the presence of the outer-peripheral-side step 56, the outer peripheral wall has a small outer diameter portion 57, which is located on the counter-motor side, and a large outer diameter portion 58, which is located on the motor side.

An opposing portion 80*h* of the pump casing 80, which is opposed to the outer-peripheral-side step 56 of the plain bearing 50 in the radial direction, is shaped into a form of a partial conical surface that progressively increases the inner diameter of the through-hole 80*g* toward the counter-motor side. Furthermore, the opposing portion 80*h* is connected to the casing bearing surface 82 on the counter-motor side. The outer-peripheral-side step 56 and the opposing portion 80*h* cooperate with each other to form an annular groove that is recessed from the casing bearing surface 82.

The inner gear 20 and the outer gear 30 are made of an iron-based sintered body that is formed by sintering iron powder. Furthermore, the inner gear 20 and the outer gear 30 are formed as trochoid gears, respectively, each of which has a plurality of teeth that are respectively configured to have a trochoid curve.

Specifically, the inner gear 20 shown in FIGS. 1 and 4 is arranged eccentrically in the gear receiving chamber 70*a* by making the inner central axis Cig of the inner gear 20 coaxial with the rotatable shaft 3*a*. Furthermore, a thickness of the inner gear 20 is set to be slightly smaller than a distance between the pair of bearing surfaces 72, 82. In this way, two opposite sides of the inner gear 20, which are opposite to each other in the axial direction Da, are rotatably supported by the pair of bearing surfaces 72, 82. Furthermore, the small outer diameter portion 57 of the plain bearing 50 rotatably supports an inner peripheral portion 22 of the inner gear 20 from the radially inner side of the inner peripheral portion 22 of the inner gear 20 in the radial direction.

Furthermore, the inner gear 20 has a plurality of insertion holes 26, which are recessed in the axial direction Da and are formed at a location that is opposed to the joint receiving chamber 71*b*. The insertion holes 26 are arranged one after another at equal intervals in the circumferential direction and extend through the inner gear 20 from the counter-motor side to the motor side.

Figure 5:
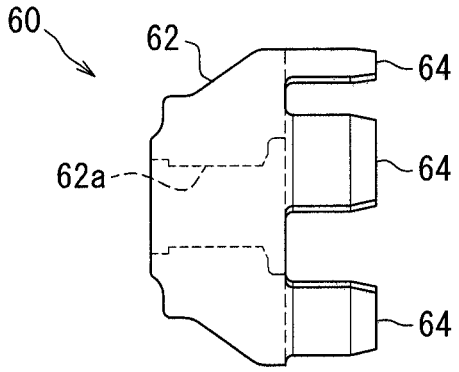
FIG. 5 is a front view showing a joint member according to the first embodiment.

Here, the joint member 60, which is shown in FIGS. 1 and 5, is made of synthetic resin, such as polyphenylene sulfide (PPS). The joint member 60 is a member that relays the rotation from the rotatable shaft 3*a* to the inner gear 20 to rotate the gears 20, 30. The joint member 60 includes a main body 62 and a plurality of inserting portions 64. The main body 62 is fitted to the rotatable shaft 3*a* through a fitting hole 62*a* of the main body 62 in the joint receiving chamber 71*b*. The plurality of inserting portions 64 is provided to correspond with the insertion holes 26, respectively. Specifically, in order to reduce the influence of the torque ripple of the electric motor 3, the number of the insertion holes 26 and the number of the inserting portions 64 are different from the number of the magnetic poles and the number of the slots of the electric motor 3. In the present embodiment, the number of the insertion holes 26 and the number of the inserting portions 64 are respectively set to five, which is a prime number. Each of the inserting portions 64 is shaped to extend in the axial direction Da from a radially outer side of the fitting hole 62*a* at the main body 62, and thereby the inserting portion 64 has flexibility.

Each of the inserting portions 64 is inserted into the corresponding one of the insertion holes 26 such that a gap is formed between the inserting portion 64 and the insertion hole 26. When the rotatable shaft 3*a* is rotated in the driving-rotational direction, the inserting portions 64 are urged against the insertion holes 26. Thereby, the drive force of the rotatable shaft 3*a* is transmitted to the inner gear 20 through the joint member 60. Specifically, the inner gear 20 is rotatable in the rotational direction Rig about the inner central axis Cig. In FIG. 4, only one of the insertion holes 26 and only one of the inserting portions 64 are indicated with the corresponding reference signs, respectively.

The inner gear 20 includes a plurality of external teeth 24*a* that are formed at an outer peripheral portion 24 of the inner gear 20 and are arranged one after another at equal intervals in the rotational direction Rig. The external teeth 24*a* project from a bottom land toward a radially outer side such that tips of the external teeth 24*a* are arranged along a circumcircle (also referred to as an addendum circle), which is circular, and the external teeth 24*a* are configured to oppose the respective ports 74, 84 and the grooves 71*a*, 80*a* in response to rotation of the inner gear 20.

As shown in FIGS. 1 and 4, the outer gear 30 is arranged eccentrically relative to the inner central axis Cig of the inner gear 20, so that the outer gear 30 is coaxially placed in the gear receiving chamber 70*a*. Thereby, the inner gear 20 is eccentrically displaced relative to the outer gear 30 in an eccentric direction De, which is a radial direction of the outer gear 30.

Furthermore, a thickness of the outer gear 30 is set to be slightly smaller than the distance between the pair of bearing surfaces 72, 82. In this way, an outer peripheral portion 34 of the outer gear 30 is rotatably supported by the inner peripheral portion 80*d* of the pump casing 80 in the radial direction, and two opposite sides of the outer gear 30, which are opposite to each other in the axial direction Da, are rotatably supported by the pair of bearing surfaces 72, 82.

The outer gear 30 is rotatable synchronously with the inner gear 20 about the outer central axis Cog that is eccentrically displaced from the inner central axis Cig. The outer gear 30 is rotatable in the rotational direction Rog.

As shown in FIG. 4, the outer gear 30 includes a plurality of internal teeth 32*a* that are formed at an inner peripheral portion 32 of the outer gear 30 and are arranged one after another at equal intervals in the rotational direction Rog. The number of the internal teeth 32*a* of the outer gear 30 is set to be larger than the number of the external teeth 24*a* of the inner gear 20 by one. In the present embodiment, the number of the internal teeth 32*a* is ten, and the number of the external teeth 24*a* is nine.

The inner gear 20 is meshed with the outer gear 30 due to the eccentricity of the inner gear 20 relative to the outer gear 30 in the eccentric direction De. Thereby, at the eccentric side, the inner gear 20 and the outer gear 30 are meshed with each other with less clearance therebetween. However, at the opposite side, which is opposite from the eccentric side, a plurality of pump chambers 40 is continuously formed one after another. Volumes of these pump chambers 40 are expanded and thereafter contracted through rotation of the outer gear 30 and the inner gear 20.

In response to the rotation of the respective gears 20, 30, the volumes of opposing ones of the pump chambers 40, which are opposed to and are communicated with the suction port 74 and the opposing suction groove 80*a*, are progressively increased. Thereby, the fuel is suctioned into the pump chambers 40 in the gear receiving chamber 70*a* through the respective suction opening holes 77 of the suction port 74. Here, the suction opening holes 77 are communicated with the suction extension groove 75, which is recessed from the cover bearing surface 72. Therefore, as long as each corresponding pump chamber 40 is opposed to the suction extension groove 75, the fuel is kept to be suctioned into the pump chamber 40.

In response to the rotation of the respective gears 20, 30, the volumes of opposing ones of the pump chambers 40, which are opposed to and are communicated with the discharge port 84 and the opposing discharge groove 71*a*, are increased. Therefore, simultaneously with the suctioning function for suctioning the fuel discussed above, the fuel is discharged from these pump chambers 40 to an outside of the gear receiving chamber 70*a* through the discharge opening holes 87 of the discharge port 84. Here, the discharge opening holes 87 are communicated with the discharge extension groove 85, which is recessed from the casing bearing surface 82. Therefore, as long as each corresponding pump chamber 40 is opposed to the discharge extension groove 85, the fuel is kept to be discharged from the corresponding pump chamber 40.

As discussed above, the fuel, which is sequentially suctioned into the pump chambers 40 in the gear receiving chamber 70*a* through the suction port 74 and is then discharged through the discharge port 84, is discharged to the outside from the discharge port 84 through the fuel passage 6. Here, because of the above-described pumping action, the fuel pressure in the opposing pump chambers 40, which are opposed to the discharge port 84, is held in a high pressure state that is higher than the fuel pressure in the other opposing pump chambers 40, which are opposed to the suction port 74. Therefore, the inner gear 20 is urged in the radial direction from the side of the pump chambers 40, which have the high pressure, toward the other pump chambers 40, which have the low pressure, so that the plain bearing 50 may receive a load in the radial direction. Furthermore, the inflow of the fuel into the gear receiving chamber 70*a* causes intrusion of the fuel into minute gaps formed in the plain bearing 50 that is made of the sintered body.

Effects and Advantages

Effects and advantages of the first embodiment discussed above will be described.

According to the first embodiment, the plain bearing 50 includes the outer-peripheral-side step 56 that is stepped by increasing the outer diameter Do2 of the plain bearing 50 on the motor side (serving as a drive source side) of the outer-peripheral-side step 56. When the outer-peripheral-side step 56 is applied to the plain bearing 50, which has the inner-peripheral-side step 52, the wall thickness of the plain bearing 50 is advantageously increased due to the increase in the outer diameter Do of the plain bearing 50. Thereby, the plain bearing 50 is reinforced. The outer-peripheral-side step 56 is positioned on the motor side of the casing bearing surface 82 in the axial direction Da. Therefore, even when the inner gear 20 is rotatably supported by the plain bearing 50 in the radial direction from the radially inner side of the inner gear 20, the inner gear 20 can be smoothly rotated since the outer-peripheral-side step 56 does not interfere with the inner gear 20. Thereby, the fuel pump 100, which has the high pump efficiency, can be provided while limiting a damage to the plain bearing 50.

By forming the outer-peripheral-side step 56, the outer profile of the plain bearing 50 becomes asymmetrical relative to the axial direction Da. Therefore, there is a decreased possibility of inadvertently placing the plain bearing 50 in an opposite orientation in the axial direction Da at the time of installing the plain bearing 50 to the fuel pump 100. Thus, the fuel pump 100, which has the high pump efficiency, can be easily provided while limiting the damage to the plain bearing 50.

Furthermore, according to the first embodiment, the outer-peripheral-side step 56 is formed at the location that is different from the location of the inner-peripheral-side step 52 in the axial direction Da. Thereby, the wall thickness of the plain bearing 50 changes at the plurality of steps, i.e., at the outer-peripheral-side step 56 and the inner-peripheral-side step 52, so that the plain bearing 50 has the shape that limits a rapid change in the wall thickness of the plain bearing 50. In this way, a damage of the plain bearing 50, which is caused by generation of a crack starting from the inner-peripheral-side step 52 or the outer-peripheral-side step 56, can be limited.

Furthermore, according to the first embodiment, the inner-peripheral-side step 52 is placed at the counter-motor side, which is the side of the casing bearing surface 82 that is opposite from the drive source in the axial direction Da. With this arrangement, the inner diameter Di does not increase at the location where the outer-peripheral-side step 56 is formed, so that the wall thickness of this location can be increased. Therefore, a damage of the plain bearing 50, which is caused by generation of a crack starting from the outer-peripheral-side step 56, can be limited.

Furthermore, according to the first embodiment, the plain bearing 50 is made of the sintered body. This type of plain bearing 50 can hold the fuel, which is supplied through the gear receiving chamber 70*a*, in the inside of the plain bearing 50, so that lubricity is enhanced. In this way, a damage of the plain bearing 50, which is caused by galling, is limited.

Here, for example, in a case where the plain bearing 50 is formed by filling powder in a sintering mold, a density of the powder may vary depending on the wall thickness of the plain bearing 50 in response to the formation of the inner-peripheral-side step 52 and the outer-peripheral-side step 56. However, in the structure where the outer-peripheral-side step 56 is formed on the motor side of the casing bearing surface 82 in the axial direction Da, and the inner-peripheral-side step 52 is formed on the counter-motor side of the casing bearing surface 82 in the axial direction Da, the inner diameter Di does not increase at the location where the outer-peripheral-side step 56 is formed. Thus, a packing density of the powder can be increased to correspond with the wall thickness of this location. Therefore, a damage of the plain bearing 50, which is caused by generation of a crack starting from the outer-peripheral-side step 56, can be limited.

Furthermore, according to the first embodiment, the pump casing 80 includes the through-hole 80*g* and the opposing portion 80*h*. The through-hole 80*g* extends through the pump casing 80 in the axial direction Da and holds the plain bearing 50. The opposing portion 80*h* is opposed to the outer-peripheral-side step 56 in the radial direction and is connected to the casing bearing surface 82. Furthermore, the opposing portion 80*h* progressively increases the inner diameter of the through-hole 80*g* toward the counter-motor side. Because of the opposing portion 80*h*, which is constructed in the above-described manner, the plain bearing 50 can be smoothly placed into the through-hole 80*g*.

Second Embodiment

Figure 6:
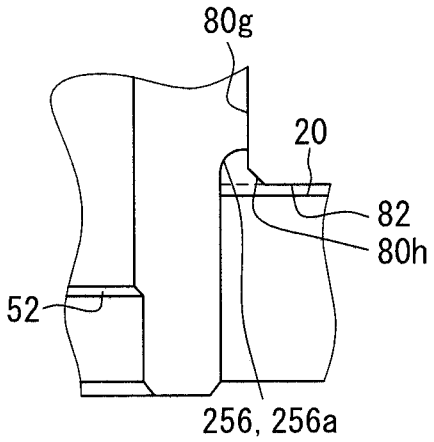
FIG. 6 is an enlarged cross-sectional view showing an outer-peripheral-side step and its adjacent area according to a second embodiment.

As shown in FIG. 6, a second embodiment of the present disclosure is a modification of the first embodiment. The second embodiment will be described mainly with respect to differences that are different from the first embodiment.

Similar to the first embodiment, an outer-peripheral-side step 256 of the second embodiment is formed at an outer peripheral wall of a plain bearing 250. The outer-peripheral-side step 256 is formed on the motor side of the casing bearing surface 82 in the axial direction Da.

Here, the cross section of the outer-peripheral-side step 256 is curved such that the outer diameter Do of the outer-peripheral-side step 256 progressively increases toward the motor side, and thereby the outer-peripheral-side step 256 has a curved surface 256*a* that is concavely curved.

According to the second embodiment, the outer-peripheral-side step 256 has the curved surface 256*a* that is concavely curved. Therefore, the stress, which is applied to the outer-peripheral-side step 256, can be spread, and thereby a damage of the plain bearing 250, which is caused by generation of a crack starting from the outer-peripheral-side step 256, can be limited.

Other Embodiments

The embodiments of the present disclosure have been described. However, the present disclosure is not necessarily limited to these embodiments and may be applied to various other embodiments and combinations of these embodiments and the above embodiments.

As s first modification, the outer-peripheral-side step 56 may be formed at the same axial location as that of the inner-peripheral-side step 52 in the axial direction Da.

As a second modification, the inner-peripheral-side step 52 may be formed on the motor side of the casing bearing surface 82 in the axial direction Da.

As a third modification, the plain bearing 50 may be made of another material that is other than the sintered body. For example, the plain bearing 50 may be made of metal that has fine dimples that are formed at a surface of the metal through a micro-dimple processing. The fuel is held by these fine dimples, and thereby the lubricity can be improved.

As a fourth modification, at least one of the suction port 74 and the discharge port 84 may have another type of structure, which is other than the opening holes 77, 87 and the extension groove 75, 85, to execute the suctioning or discharging of the fuel.

As a fifth modification, a portion or a whole of the pump housing 70 may be made of aluminum or a non-metal material, such as synthetic resin, which is other than metal.

As a sixth modification, the fuel pump 100 may be a fuel pump that suctions and discharges another type of fuel that is other than the light oil, such as gasoline or a liquid fuel that is equivalent to the light oil or gasoline.

The invention claimed is:

1. A fuel pump comprising:

an outer gear that includes a plurality of internal teeth;

an inner gear that includes a plurality of external teeth and is meshed with the outer gear while the inner gear is eccentric to the outer gear;

a pump housing that defines a gear receiving chamber, which rotatably receives the outer gear and the inner gear;

a rotatable shaft that is coupled to an electric motor and is rotated by the electric motor; and a plain bearing that is shaped into a cylindrical tubular form, while the plain bearing rotatably supports the rotatable shaft in a radial direction from a radially outer side of the rotatable shaft and rotatably supports the inner gear in the radial direction from a radially inner side of the inner gear, and when the outer gear and the inner gear are rotated in response to rotation of the rotatable shaft to increase and decrease volumes of a plurality of pump chambers, which are formed between the outer gear and the inner gear, fuel is suctioned into and is then discharged from the gear receiving chamber, wherein:

the pump housing includes a bearing surface that rotatably supports the inner gear in an axial direction from the electric motor side, while the plain bearing extends through the bearing surface; and the plain bearing includes:

an inner-peripheral-side step that is stepped by increasing an inner diameter of the plain bearing on an opposite side of the inner-peripheral-side step, which is opposite from the electric motor in the axial direction; and an outer-peripheral-side step that is stepped by increasing an outer diameter of the plain bearing on the electric motor side of the outer-peripheral-side step at a position that is on the electric motor side of the bearing surface in the axial direction, and the pump housing includes:

a through-hole that extends through the pump housing in the axial direction and holds the plain bearing; and an opposing portion that is opposed to the outer-peripheral-side step in the radial direction and is connected to the bearing surface, wherein the opposing portion progressively increases an inner diameter of the through-hole toward the opposite side in the radial direction.

2. The fuel pump according to claim 1, wherein the outer-peripheral-side step is placed at a location that is different from a location of the inner-peripheral-side step in the axial direction.

3. The fuel pump according to claim 1, wherein the inner-peripheral-side step is placed on the opposite side of the bearing surface of the pump housing in the axial direction.

4. The fuel pump according to claim 1, wherein the plain bearing is made of a sintered body.

5. The fuel pump according to claim 1, wherein the outer-peripheral-side step has a curved surface that is concavely curved.

* * * * *